US011740050B2

(12) United States Patent
Alomaira

(10) Patent No.: US 11,740,050 B2
(45) Date of Patent: Aug. 29, 2023

(54) RIFLE STOCK

(71) Applicant: Caracal International, LLC, Abu Dhabi (AE)

(72) Inventor: Naser Ali Alomaira, Khalifa A (AE)

(73) Assignee: CARCAL INTERNATIONAL, LLC, Abu Dhabi (AE)

( * ) Notice: Subject to any disclaimer, the term of this patent is extended or adjusted under 35 U.S.C. 154(b) by 1 day.

(21) Appl. No.: 17/324,261

(22) Filed: May 19, 2021

(65) Prior Publication Data

US 2021/0381799 A1 Dec. 9, 2021

Related U.S. Application Data

(60) Provisional application No. 63/035,113, filed on Jun. 5, 2020.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/20
See application file for complete search history.

(56) References Cited

U.S. PATENT DOCUMENTS

| | | | | |
|---|---|---|---|---|
| 9,551,549 | B1 | 1/2017 | Chvala | |
| 11,105,582 | B1 * | 8/2021 | Spuhr | F41C 23/14 |
| 2013/0180148 | A1 | 7/2013 | Rogers et al. | |
| 2019/0204044 | A1 * | 7/2019 | Overstreet | F41C 23/14 |
| 2020/0182586 | A1 * | 6/2020 | Zhang | F41C 23/20 |
| 2020/0240743 | A1 * | 7/2020 | Cahill | F41C 23/02 |

FOREIGN PATENT DOCUMENTS

| | | | |
|---|---|---|---|
| EP | 2021727 | B1 | 5/2010 |
| KR | 10-1997741 | B1 | 7/2019 |
| WO | 2014-078462 | A1 | 5/2014 |

* cited by examiner

*Primary Examiner* — J. Woodrow Eldred
(74) *Attorney, Agent, or Firm* — Bennet K. Langlotz; Langlotz Patent & Trademark Works, LLC

(57) ABSTRACT

A rifle stock has a frame, a body having a butt pad connected to the frame and operable to move within a range of length of pull positions, the frame defining a plurality of pockets, each associated with a different length of pull position, the body defining a latch passage, a latch having a nose, the latch received in the latch passage and movable between a retracted position in which the nose is clear of the pockets and movement of the body is enabled for adjusting, and an extended position in which the nose is received in a selected one of the pockets, a release lever pivotally connected to the frame and operably connected to the latch, and the release lever movable between an operating position in which the latch is in the extended position, and an adjustment position in which the latch is in the retracted position.

21 Claims, 7 Drawing Sheets

RIFLE STOCK

CROSS-REFERENCE TO RELATED APPLICATION

This application claims the benefit of U.S. Provisional Patent Application No. 63/035,113 filed on Jun. 5, 2020, entitled "Rifle Butt," which is hereby incorporated by reference in its entirety for all that is taught and disclosed therein.

FIELD OF THE INVENTION

The present invention relates to firearms, and more particularly to a rifle stock that enables the rifle's length of pull to be easily and quickly adjusted using one hand.

BACKGROUND AND SUMMARY OF THE INVENTION

Rifle stocks provide many advantages to the user when they are installed on a rifle. Rifle stocks enable the shooter to brace the firearm with their shoulder, which provides a stable firing platform to increase accuracy and absorb recoil forces. The length of the stock establishes the rifle's length of pull, which is the distance from the rear end of the stock to the shooter's trigger finger when resting on the rifle's trigger. Many rifles are manufactured with stocks having a standard length of pull of 13.5 inch, which is believed to fit most shooters. However, this length of pull is not suitable for all shooters. An improper length of pull can prevent the shooter from assuming proper body position when shooting, potentially harming the rifle's accuracy. A rifle with a length of pull that is too long or too short can result in the shooter creating undesirable lateral movement of the rifle when pulling the trigger. The shooter may have to assume an uncomfortable body position to compensate, which increases fatigue.

Although prior art rifle stocks with adjustable length of pull exist, they often employ complex adjustment mechanisms that are time consuming or otherwise difficult to operate and can require both hands to operate. This requires the shooter to return the rifle to the shooting position potentially multiple times to test the effect of each length of pull adjustment, which prevents the shooter from maintaining a sight picture of a target while adjusting the rifle's length of pull.

Therefore, a need exists for a new and improved rifle stock that enables the rifle's length of pull to be easily and quickly adjusted using one hand. In this regard, the various embodiments of the present invention substantially fulfill at least some of these needs. In this respect, the rifle stock according to the present invention substantially departs from the conventional concepts and designs of the prior art, and in doing so provides an apparatus primarily developed for the purpose of enabling the rifle's length of pull to be easily and quickly adjusted using one hand.

The present invention provides an improved rifle stock, and overcomes the above-mentioned disadvantages and drawbacks of the prior art. As such, the general purpose of the present invention, which will be described subsequently in greater detail, is to provide an improved rifle stock that has all the advantages of the prior art mentioned above.

To attain this, the preferred embodiment of the present invention essentially comprises a frame configured for connection to rifle, a body having a butt pad connected to the frame and operable to move within a range of length of pull positions, the frame defining a plurality of pockets, each associated with a different length of pull position, the body defining a latch passage, a latch having a nose, the latch received in the latch passage and movable between a retracted position in which the nose is clear of the pockets and movement of the body with respect to the frame is enabled for adjusting a length of pull, and an extended position in which the nose is received in a selected one of the pockets, a release lever pivotally connected to the frame and operably connected to the latch, and the release lever movable between an operating position in which the latch is in the extended position, and an adjustment position in which the latch is in the retracted position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
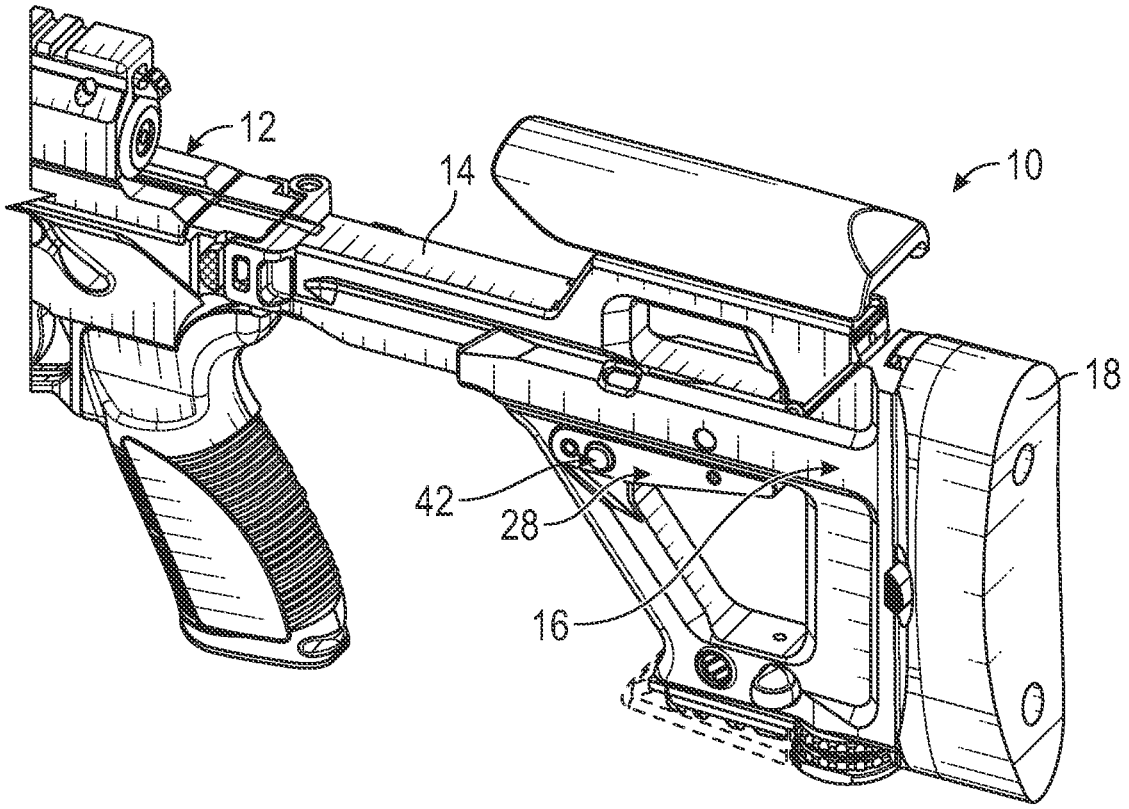
FIG. 1 is a top isometric view of the current embodiment of a rifle stock constructed in accordance with the principles of the present invention in use attached to a rifle.
Figure 2:
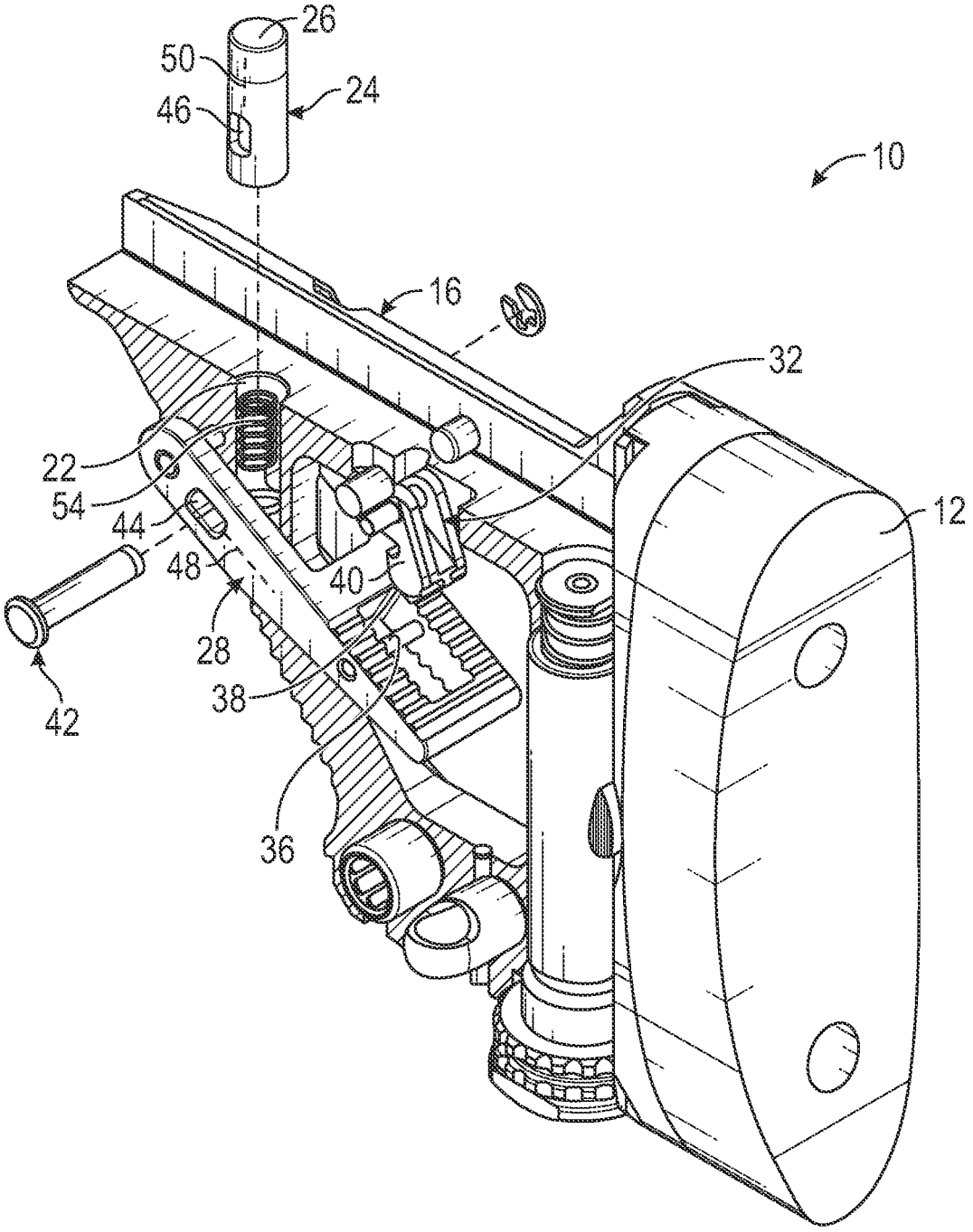
FIG. 2 is a partially exploded sectional view of the rifle stock of FIG. 1 detached from the rifle.
Figure 3:
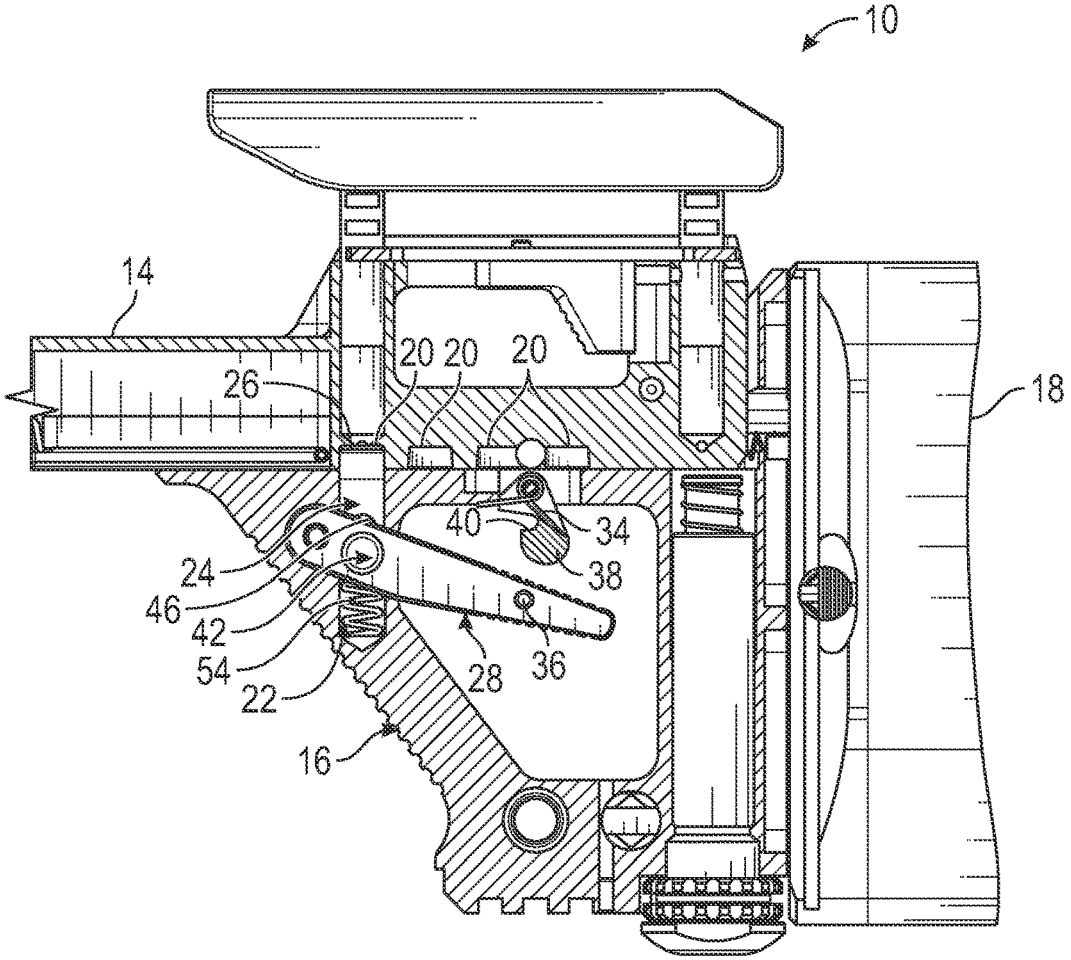
FIG. 3 is a side sectional view of the rifle stock of FIG. 1 detached from the rifle.
Figure 4:
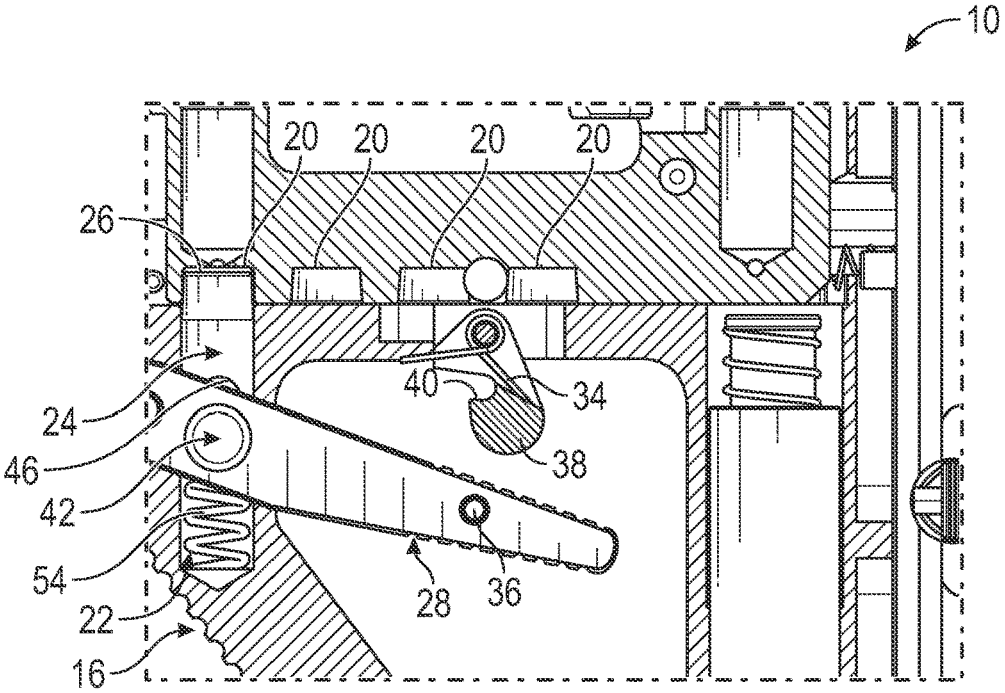
FIG. 4 is an enlarged view of the rifle stock of FIG. 3.

An embodiment of the rifle stock of the present invention is shown and generally designated by the reference numeral 10.

FIGS. 1-4 illustrate the improved rifle stock 10 of the present invention. More particularly, FIG. 1 shows the rifle stock in use attached to a rifle 12. The rifle stock has a frame 14 configured for connection to the rifle. A body 16 has a butt pad 18 connected to the frame and operable to move within a range of length of pull positions. The frame defines a plurality of pockets 20, each associated with a different length of pull position. The body also defines a latch passage 22 that receives a latch 24 having a nose 26. The latch is movable between a retracted position in which the nose is clear of the pockets and movement of the body with respect to the frame is enabled for adjusting a length of pull, and an extended position in which the nose is received in a selected one of the pockets. A release lever 28 is pivotally connected to the frame and operably connected to the latch by a transverse pin 42. The release lever is movable between an operating position in which the latch is in the extended position, and an adjustment position in which the latch is in the retracted position. The release lever is spring biased toward an intermediate position between the extended position and the retracted position by a first spring 30 (shown in FIGS. 5A-H). The nose and pockets are tapered to create a wedging engagement of the latch with the pockets. The latch defines an elongated slot 44, and the release lever defines an elongated slot 46. Both elongated slots receive the transverse pin. The latch defines a major axis 48, and the elongated slot 44 is oriented parallel to the major axis 48. The release lever defines a major axis 50, and the elongated slot 46 is oriented parallel to the major axis 50.

The latch 24 is a tubular body in the current embodiment having an upper bore portion 52 above the transverse pin 42 that receives the first spring 30 (shown in FIGS. 5A-H). A second spring 54 is located between the latch and the body 16 within the latch passage 22. The first spring biases the nose 26 of the latch away from the release lever 28. The second spring biases the latch away from the body.

A catch 32 movable between a retention position and a release position is operable to retain the release lever 28 in the operating position when the catch is in the retention position. The catch is biased by spring 34 toward the retention position. The catch moves away from the retention position in response to movement of the release lever toward the operating position, and the catch moves to the retention position in response to the release lever reaching the operating position via interaction of a pin 36 in the release lever with a cam surface 38 on the catch. The pin is received in a slot 40 in the catch to retain the release lever in the operating position when the catch is in the retention position.

Figure 5A:
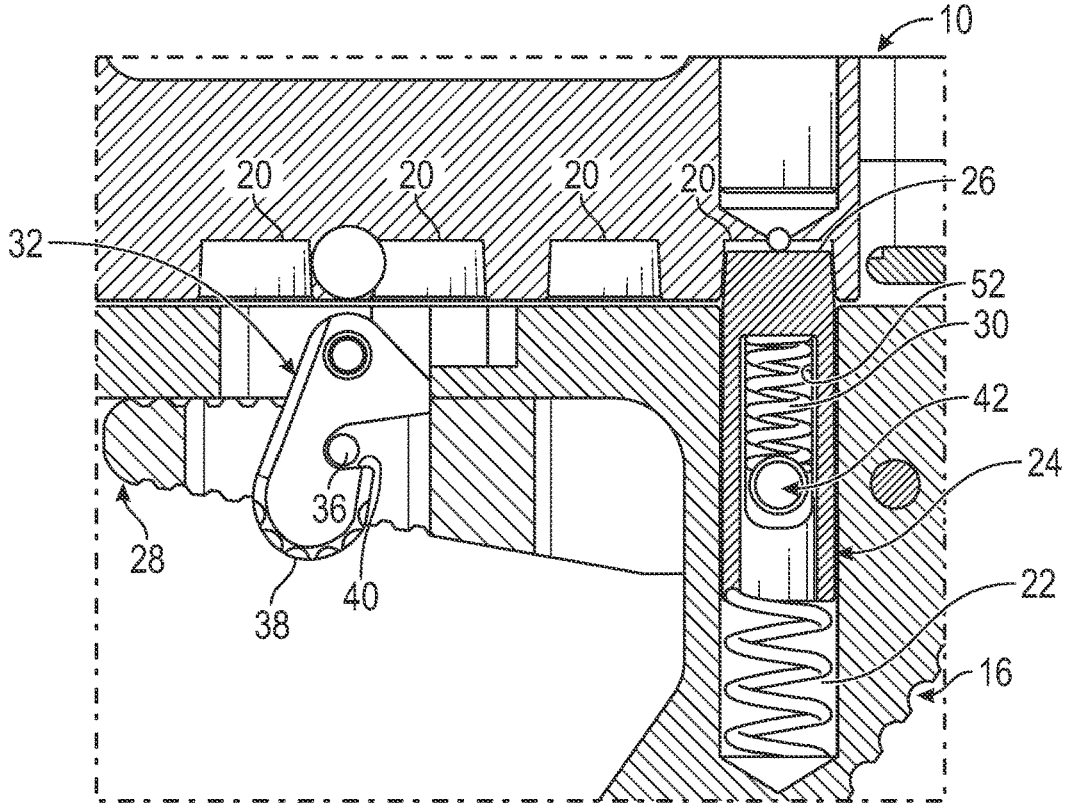
FIG. 5A is a side sectional view of the rifle stock of FIG. 1 with the catch in the retention position retaining the release lever in the operating position.
Figure 5B:
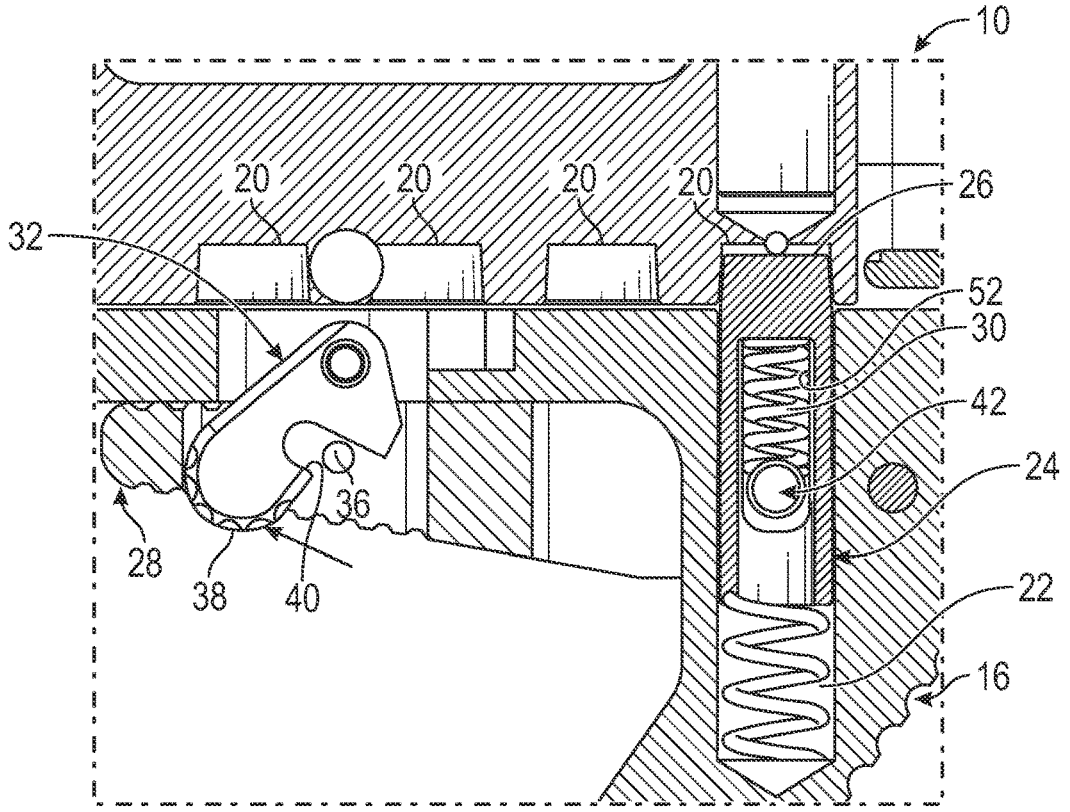
FIG. 5B is a side sectional view of the rifle stock of FIG. 1 with the catch in the release position no longer retaining the release lever in the operating position.
Figure 5C:
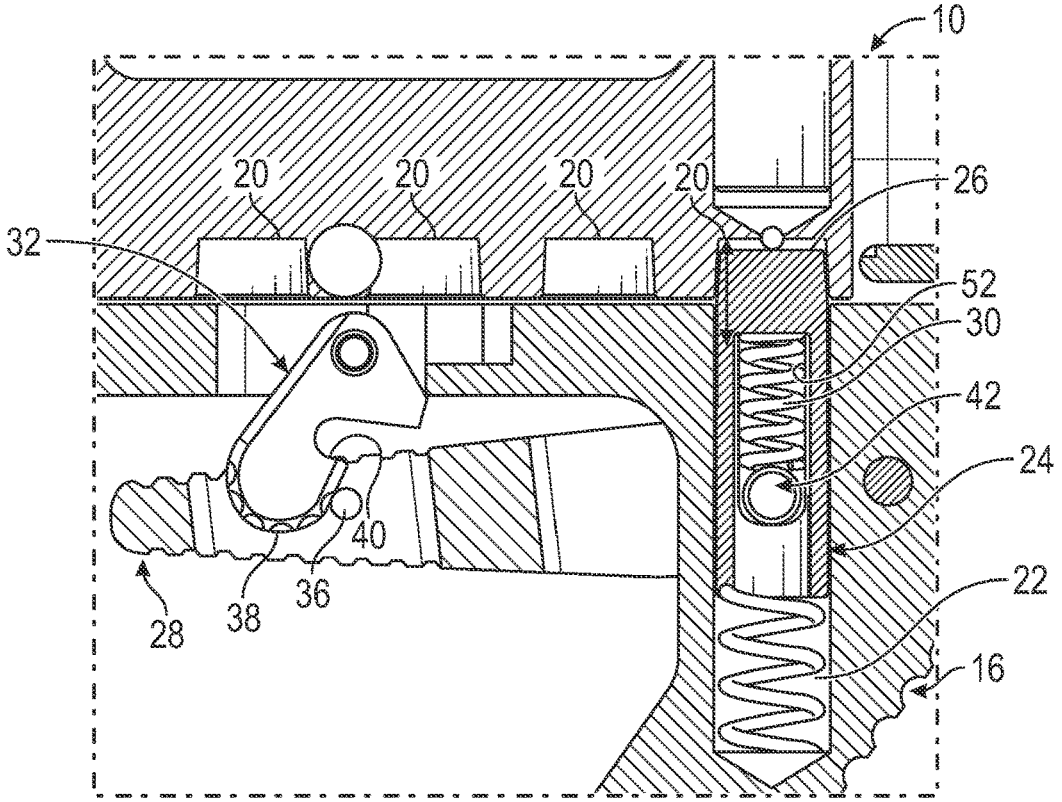
FIG. 5C is a side sectional view of the rifle stock of FIG. 1 with the catch in the release position and the release lever having been spring biased out of the operating position.
Figure 5D:
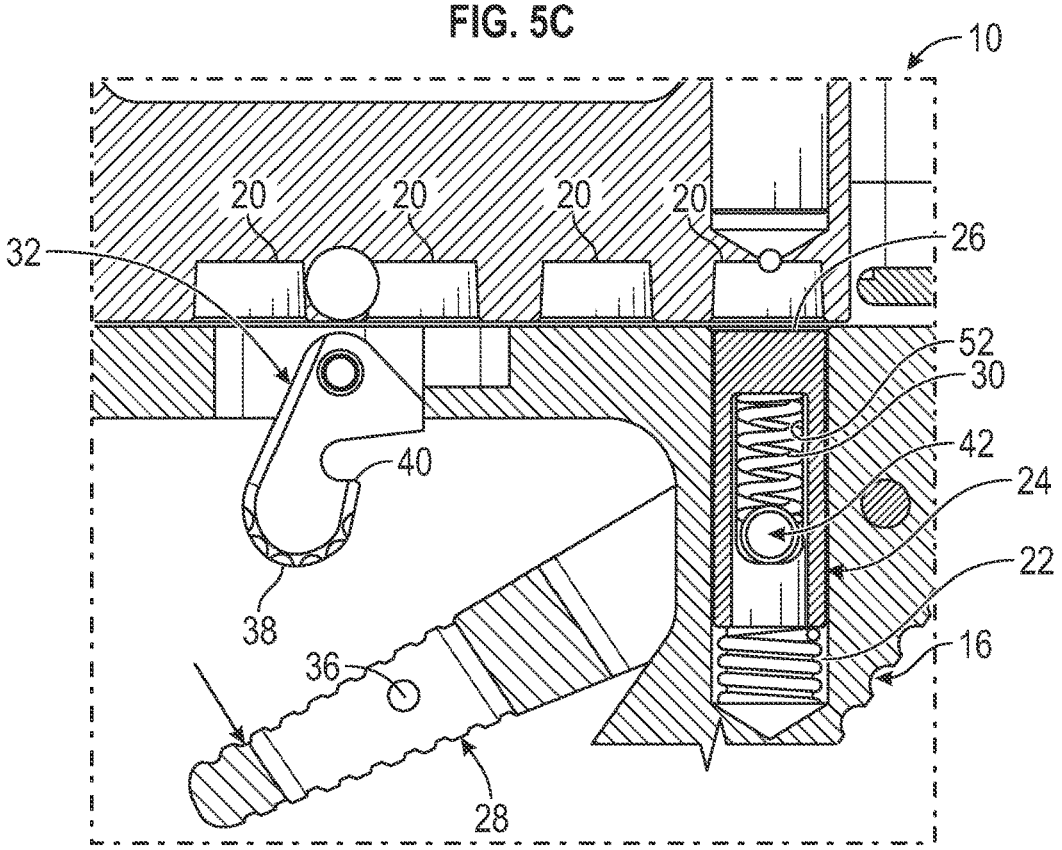
FIG. 5D is a side sectional view of the rifle stock of FIG. 1 with the catch having been spring-biased back to the retention position and the release lever having been pushed downward to disengage the latch from a pocket.
Figure 5E:
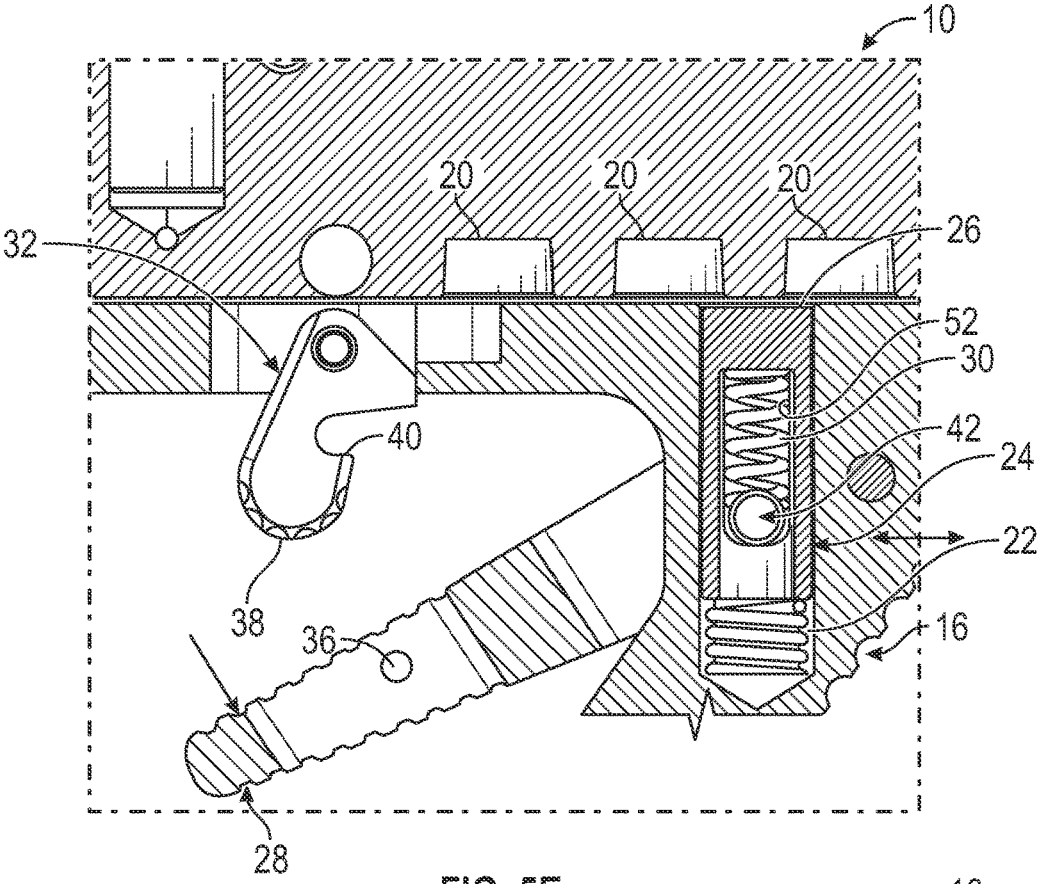
FIG. 5E is a side sectional view of the rifle stock of FIG. 1 with the catch in the retention position and the release lever being held downward while the latch is moved to a new pocket to adjust the length of pull.
Figure 5F:
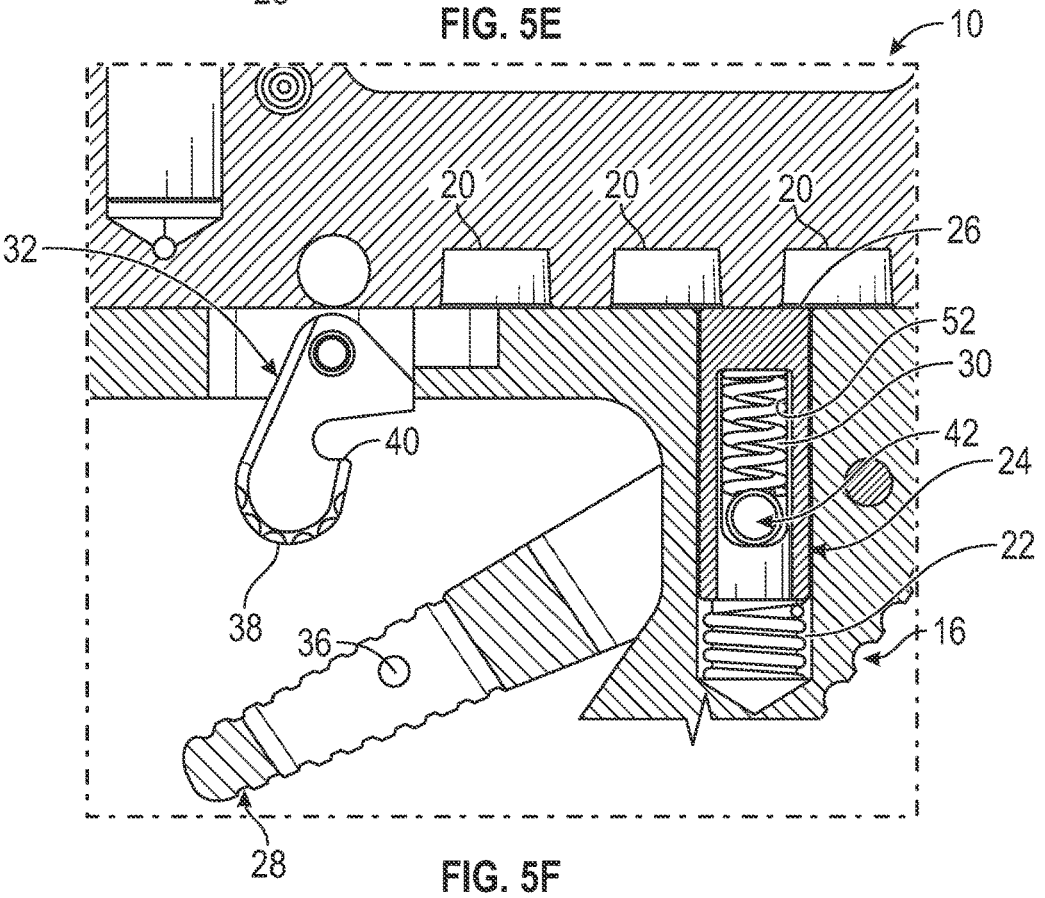
FIG. 5F is a side sectional view of the rifle stock of FIG. 1 with the catch in the retention position and the release lever having been released so the release lever and latch are spring biased upward.
Figure 5G:
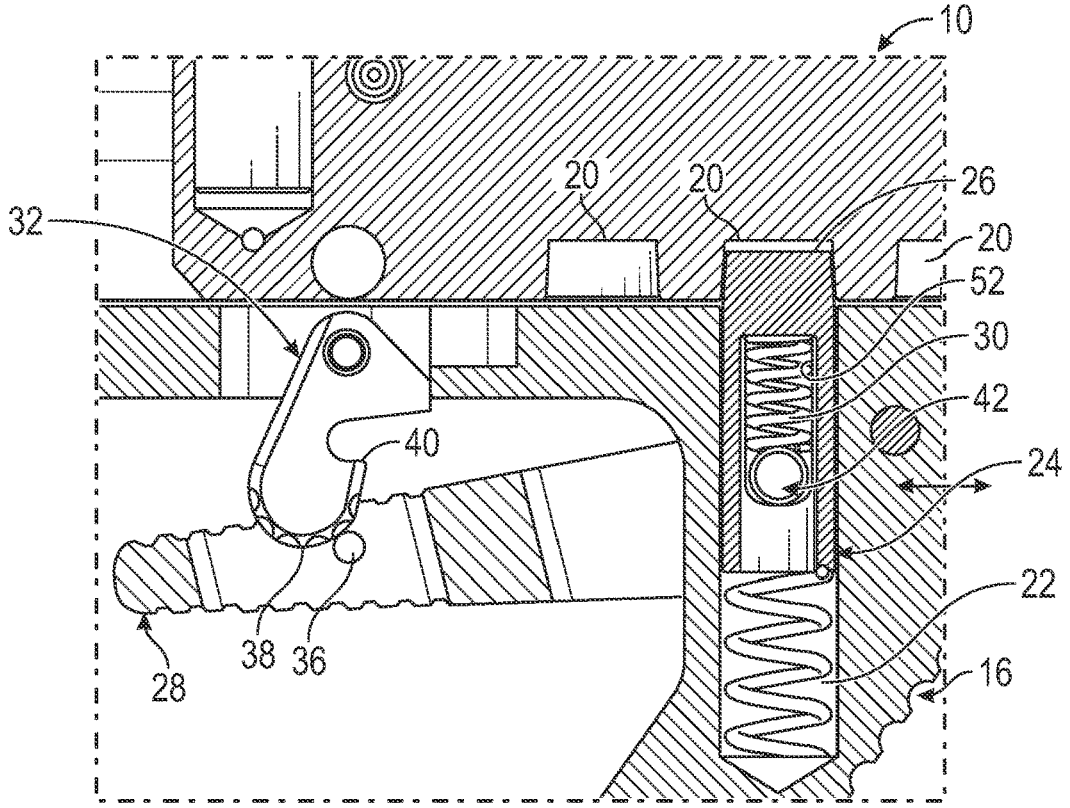
FIG. 5G is a side sectional view of the rifle stock of FIG. 1 with the catch in the retention position and the release lever having been released so the release lever and latch are spring biased upward into the new pocket to adjust the length of pull.
Figure 5H:
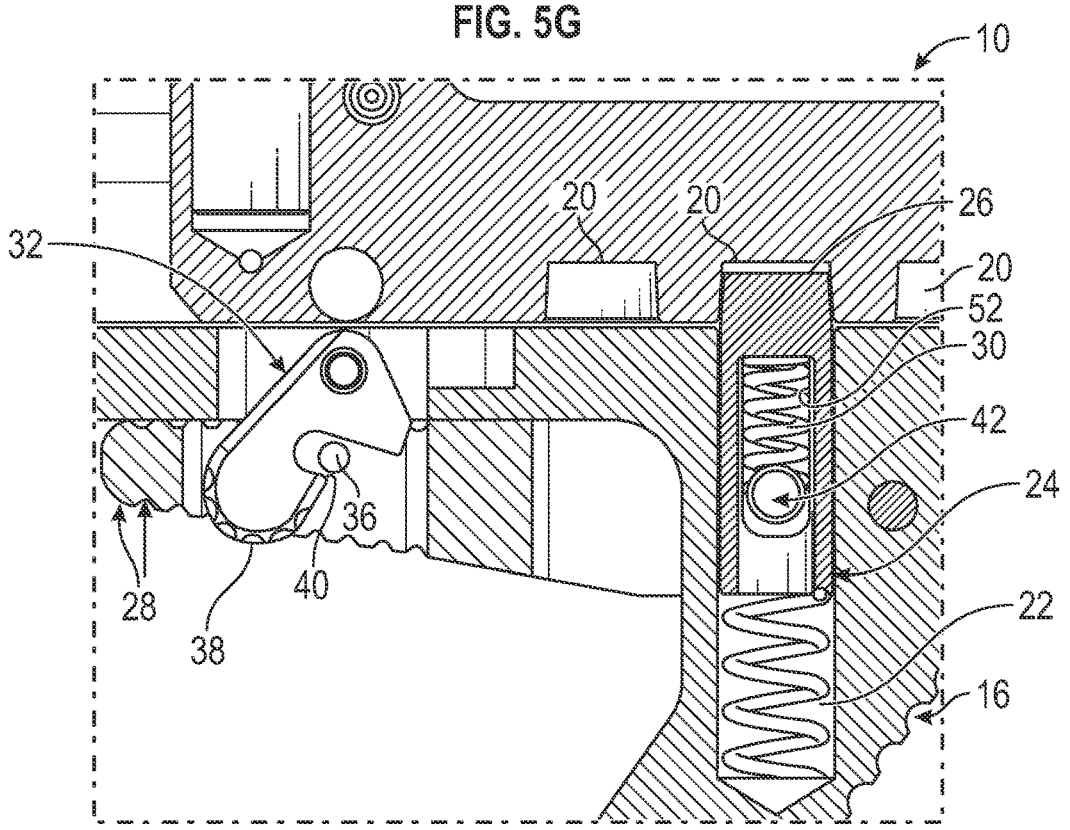
FIG. 5H is a side sectional view of the rifle stock of FIG. 1 with the catch in the partially released position as the release lever is pushed upward into the operating position.

FIGS. 5A-H illustrate the improved rifle stock 10 of the present invention. More particularly, the figures illustrate the sequence of operation to adjust the length of pull of the rifle 12 (not shown). FIG. 5A shows the rifle stock with the catch 32 in the retention position retaining the release lever 28 in the operating position, with the pin 36 received in the slot 40 in the catch. FIG. 5B shows the rifle stock with the catch in the release position no longer retaining the release lever in the operating position with the pin disengaged from the slot in the catch. FIG. 5C shows the rifle stock with the catch in the release position and the release lever having been spring biased out of the operating position by first spring 30 pushing downward on the transverse pin 42. FIG. 5D shows the rifle stock with the catch having been spring-biased back to the retention position by spring 34 and the release lever having been pushed downward by the shooter's support hand (not shown) to disengage the latch from a pocket 20. FIG. 5E shows the rifle stock with the catch in the retention position and the release lever being held downward by the shooter's support hand (not shown) while the latch is moved to a new pocket to adjust the length of pull of the rifle 12. FIG. 5F shows the rifle stock with the catch in the retention position and the release lever having been released by the shooter's support hand (not shown) so the release lever and latch are spring biased upward by second spring 54. FIG. 5G shows the rifle stock with the catch in the retention position and the release lever having been released by the shooter's support hand (not shown) with the latch axially registered with a new pocket so the release lever and latch are spring biased upward into the new pocket by the second spring pushing upward on the transverse pin to adjust the length of pull of the rifle. FIG. 5H shows the rifle stock with the catch in the partially released position as the release lever is pushed upward into the operating position by the shooter's support hand (not shown). The interaction of the pin 36 in the release lever with the cam surface 38 on the catch moves the catch into the partially released position. Further upward movement of the release lever into the operating position returns the rifle stock to the normal operating condition shown in FIG. 5A.

It should be appreciated that the sequence of operation to adjust the length of pull of the rifle 12 is accomplished by only the shooter's support hand, which permits the shooter to remain in the shooting position to immediately ascertain the effect of the length of pull adjustment while maintaining a sight picture of the target and being ready to fire. Furthermore, the first spring 30 above the transverse pin 42 and the second spring 54 below the transverse pin apply sufficient spring pressure to the transverse pin to eliminate inherent residual movement between the release lever 28 and latch 24, and body 16 that would otherwise result from fitting tolerances creating play/wobble.

Furthermore, the operation to adjust the length of pull of the rifle 12 is ambidextrous for use by both left and right-handed shooters. The single-hand adjustment capability is enabled by a spring in the stock, which biases the stock rearward. When the user releases the stock for adjustment, the stock extends rearward telescopically against the user's shoulder. The user then compresses the stock between their shoulder and support hand to adjust the length of pull to the desired amount. There may be a labeled numbering system denoting various length of pull adjustments to make repeatable adjustment easy for the user. The distance between each length of pull adjustment position could be adjusted to meet a user's requirements for the overall range of adjustment and/or how much adjustment occurs between adjustment positions.

In the context of the specification, the terms "rear" and "rearward," and "front" and "forward," have the following definitions: "rear" or "rearward" means in the direction away from the firearm while "front" or "forward" means it is in the direction towards the firearm.

While a current embodiment of a rifle stock has been described in detail, it should be apparent that modifications and variations thereto are possible, all of which fall within the true spirit and scope of the invention. Although rifles have been disclosed, the rifle stock is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle stock comprising:

a frame configured for connection to rifle;

a body having a butt pad connected to the frame and operable to move within a range of length of pull positions;

the frame defining a plurality of pockets, each associated with a different length of pull position;

the body defining a latch passage;

a latch having a nose, the latch received in the latch passage and movable between a retracted position in which the nose is clear of the pockets and movement of the body with respect to the frame is enabled for adjusting a length of pull, and an extended position in which the nose is received in a selected one of the pockets;

the latch having a forward surface that in the extended position contacts a forward portion of the selected one of the pockets, and having a rear surface that in the extended position contacts a rear portion of the selected one of the pockets to provide a wedging engagement between the latch and the selected one of the pockets to prevent movement of the body with respect to the frame;

a release lever pivotally connected to the frame and operably connected to the latch; and the release lever movable between an operating position in which the latch is in the extended position, and an adjustment position in which the latch is in the retracted position.

2. The rifle of claim 1 including a catch movable between a retention position and a release position and operable to retain the release lever in the operating position when the catch is in the retention position.

3. The rifle of claim 2 wherein the catch is biased toward the retention position.

4. The rifle of claim 2 wherein the catch moves away from the retention position in response to movement of the release lever toward the operating position, and the catch moves to the retention position in response to the release lever reaching the operating position.

5. The rifle of claim 1 wherein the latch nose is tapered.

6. The rifle of claim 1 wherein the pockets are tapered.

7. The rifle of claim 1 including a first spring biasing the nose of the latch away from the release lever.

8. The rifle of claim 7 including a second spring biasing the latch away from the body.

9. A rifle stock comprising:

a frame configured for connection to rifle;

a body having a butt pad connected to the frame and operable to move within a range of length of pull positions;

the frame defining a plurality of pockets, each associated with a different length of pull position;

the body defining a latch passage;

a latch having a nose, the latch received in the latch passage and movable between a retracted position in which the nose is clear of the pockets and movement of the body with respect to the frame is enabled for adjusting a length of pull, and an extended position in which the nose is received in a selected one of the pockets;

a release lever pivotally connected to the frame and operably connected to the latch;

the release lever movable between an operating position in which the latch is in the extended position, and an adjustment position in which the latch is in the retracted position;

wherein the release lever is spring biased toward an intermediate position between the operating position and the adjustment position, a first spring biasing the release lever from the operating position to the intermediate position and a second spring biasing the release lever from the adjustment position to the intermediate position.

10. The rifle of claim 9 including a catch movable between a retention position and a release position and operable to retain the release lever in the operating position when the catch is in the retention position.

11. The rifle of claim 10 wherein the catch is biased toward the retention position.

12. The rifle of claim 10 wherein the catch moves away from the retention position in response to movement of the release lever toward the operating position, and the catch moves to the retention position in response to the release lever reaching the operating position.

13. The rifle of claim 9 wherein the latch nose is tapered.

14. The rifle of claim 9 wherein the pockets are tapered.

15. The rifle of claim 9 including wherein the latch and the release lever are engaged to each other by a transverse pin.

16. The rifle of claim 15 wherein at least one of the latch and the release lever defines an elongated slot receiving the transverse pin.

17. The rifle of claim 16 wherein the elongated slot is oriented parallel to a major axis defined by at least one of the latch and the release lever.

18. The rifle of claim 15 wherein the latch is a tubular body and has an upper bore portion above the transverse pin and receiving a first spring.

19. The rifle of claim 18 including a second spring between the latch and the body.

20. The rifle of claim 9 including a first spring biasing the nose of the latch away from the release lever.

21. The rifle of claim 20 including a second spring biasing the latch away from the body.

* * * * *